US005230102A

United States Patent [19]

Osmond

[11] Patent Number: 5,230,102

[45] Date of Patent: Jul. 27, 1993

[54] PRIMER ACTIVATED SYPHON FLUSHER FOR TOILETS

[76] Inventor: John S. Osmond, 731 Cedar St., Santa Monica, Calif. 90405

[21] Appl. No.: 695,402

[22] Filed: May 3, 1991

[51] Int. Cl.[5] ..... E03D 1/06

[52] U.S. Cl. ..... 4/370

[58] Field of Search ..... 4/376, 368, 369, 374, 4/377, 370, 376

[56] References Cited

FOREIGN PATENT DOCUMENTS

| | | | |
|---|---|---|---|
| 0029500 | 8/1907 | Australia | 4/377 |
| 0017666 | of 1889 | United Kingdom | 4/376 |
| 0012717 | of 1893 | United Kingdom | 4/376 |
| 0003023 | of 1894 | United Kingdom | 4/376 |

*Primary Examiner*—Charles E. Phillips
*Attorney, Agent, or Firm*—William H. Maxwell

[57] ABSTRACT

A toilet flushing apparatus characterized by an inherently leakproof syphon discharge through a toilet flush tube, control being of two forms (1) a pre-primed syphon wherein both the suction leg and the discharge leg are filled with water, and (2) a jet primed syphon wherein the suction leg is filled with supply tank water and the discharge leg is dry and with a floating flush valve for complete discharge of primer water followed by immediate closure to ensure continued syphoning, there being a primer tank automatically refilled with the rise of float controlled supply tank water; only primer tank water may be lost.

7 Claims, 3 Drawing Sheets

8
8
31
35

10
13
14
32
33
5
11
34
12
20
21
22
V
P
25'
24
23

31
13
10
14
35
5
11
12
P
33
32
34
V
35
24
23

31
35
36

PRIMER ACTIVATED SYPHON FLUSHER FOR TOILETS

BACKGROUND OF THE INVENTION

A common flushing apparatus for toilets involves a reseating flush valve that holds a large volume of supply water in a tank from which it is suddenly released into the toilet bowl. And, a float valve is responsive to the water level in the tank to replace the water level, operating automatically and separately from the flush valve that is manually operated by movement of a flush handle or lever that is turned to lift the flush valve. A detrimental feature of this common system is that the flush valve tends to and eventually leaks, resulting in continued water waste.

Another flushing apparatus, common in the United Kingdom, involves a syphon tube having its suction leg depending into the supply tank so as to be filled with water, and its discharge leg normally empty of water and opening into the toilet bowl, and operated by means of a primer pump that is manually actuated to fill the discharge leg thereby initiating syphoning. The said primer pump operates as a water lifting means in the suction leg of the syphon, and the advantage of this syphon system is that there can be no leakage from the supply tank through the inactive syphon. However, the pump means gradually deteriorates and requires repeated cycles of operation in order to complete a flushing of the toilet, and eventually become inoperative.

In view of the foregoing, it is an object of this invention to employ the aforesaid syphon tube flush principle of operation to the exclusion of pump means, and replacing the aforesaid pump-type primer means with a syphon primer means activated by opening of the flush valve, all in combination with an otherwise conventional toilet.

The syphon principle of operation is superior with respect to the conservation of water, in that there can be no continuous leakage therethrough when its discharge leg is empty of water. And, only when the discharge leg is primed does water flow therethrough. On the contrary, the conventional flush valve principle of operation is prone to continuous leakage from the water supply tank and through the flush tube, due to deterioration of either the valve seat or valve ball. It becomes apparent therefore that the syphon principle is superior, except for the inevitable deterioration of the United Kingdom type pump means thereof which typically deteriorates and requires repeated cycles of operation in order to complete a flushing of the toilet, and inevitably becomes inoperative.

In view of the foregoing, it is an object of this invention to employ the aforesaid syphon tube flush principle of operation to the exclusion of a pump means, and replacing the aforesaid pump-type primer means with a pre-primer means or jet-type primer means, either of which is operable by opening the flush valve, and all in combination with an otherwise conventional toilet. It becomes apparent therefore that the United Kingdom syphon principle is superior, except for the inevitable deterioration of the pump means thereof which is typically a flap or disc of flexible material that lifts the tank water into the syphon and initiates continued flow therethrough until the water supply tank is emptied through the flush tube. Accordingly, these two widely used principles of operation are each subject to deficiencies, one to inherent leakage and the other to eventual inoperation. In view of the foregoing, it is an object of this invention to provide a toilet flushing apparatus that virtually eliminates leakage of the flush water, and that provides automatic refilling of a primer tank for repeated flushings.

It is to be understood that the water supply tank is refilled after each flushing operation, or incomplete flushing operation, by means of a conventional and accepted water level responsive valve means for a water supply service pipe. In practice, a float controlled valve returns the tank water level to the bridge of the syphon after each flushing operation, complete or incomplete. And, it is this maintained water level that automatically refills the primer tank.

The syphon principle of operation is characterized by two conditions, a passive condition wherein the discharge leg is closed or dry, and a functioning condition wherein the discharge leg is open or wet. In order to achieve said closed or dry condition, filling of the water supply tank is performed with the flush valve closed at the bottom of the primer tank and at the bottom opening of the discharge leg. In a first embodiment of this invention as shown in FIGS. 3 to 5, the flush valve simultaneously closes the primer tank and the bottom opening of the discharge leg, the bottoms of the primer tank and discharge leg being in open communication. In a second embodiment of this invention as shown in FIGS. 6 to 8, the flush valve closes the bottom of the primer tank leaving the discharge leg empty, the open discharge leg being open to the flush tube and into the toilet.

In order to achieve said wet condition, priming is required for filling the otherwise dry discharge leg with water, whereby syphoning action is initiated and continues to occur. It is an object of this invention to initiate syphoning by pre-priming or by discharging a relatively small volume of water through the flush tube so as to prime and thereby initiate the syphon effect. In the first embodiment flooding of the syphon discharge leg enables the syphon to function. In the second embodiment jet pump flooding of the syphon discharge leg enables the syphon to function. Accordingly, the apparatus herein disclosed is characterized by a manually activated primer means in the form of a primer tank that dumps water into and floods the flush tube, which is also open communication with the syphon discharge tube.

The sudden discharge of primer tank water into the flush tube is a prerequisite to successful flushing, and to this end it is an object of this invention to provide flush valve control means by which primer tank water is withheld from discharge until it is desired to initiate syphon effect and ensure its continued function.

In the first embodiment of this invention, the flush valve is positioned at the bottom of the syphon discharge leg in open communication with both the discharge leg and primer tank water, both legs of the syphon being primed when the storage tank water level is automatically replenished. As in the second embodiment, only the primer water is lost when the flush valve ages and/or deteriorates, so that storage tank water never lost. In practice, operation is restored by simply re-filling the primer tank, and repair is by cleaning or replacement of the valve seat or flush valve. Accordingly, it is an object of this invention to prevent closure of the syphon when the primer tank water is depleted, and to this end means is provided to ensure flotation of the flush valve during flow of water from the bottom of the syphon discharge tube, all of which is accomplished by upward reaction of water thrust against the flush valve, as will be described.

The closure of the syphon to atmosphere upon sudden termination of primer tank water discharge is a prerequisite to successful flushing of the second embodiment (FIGS. 6 to 8), and to this end it is an object of this invention to provide flush valve control means by which the flush valve closes as and when the primer tank water is depleted, thereby shutting off the outside atmosphere for continued syphoning. The flush valve is a conventional floating ball-type valve. In practice, the aforesaid means by which primer tank water is controlled involves lift means by which the flush valve is raised, and shut off means by which the flush valve is closed. As will be described, the flush valve is raised by a lever operated toggle with a sear that lifts and drops the flush valve onto a seat that opens into the toilet flush pipe to initiate continued syphoning. This flush valve control means is advantageously used with both embodiments.

SUMMARY OF THE INVENTION

This invention relates to water closets or toilets and particularly to the flushing apparatus therefor by which defication and urination etc. is disposed of as sewage. Heretofore, substantial quantities of water have been wasted by flushing apparatus employed, as by inherent leakage and by mechanical deterioration resulting in malfunction and/or insufficient operation requiring repeated flushing attempts. The flush valve type of apparatus that is manually activated to open the conventional flush tube is subject to continuous leakage and waste of water, while the non-leak syphon type apparatus inevitably deteriorates mechanically and eventually becomes inoperative. However, it is an object of and this invention combines the advantages of the non-leak syphon type apparatus with a primer means, whereby the pump means is eliminated and the controlling flush valve is subject only to a small amount of leakage from the primer tank only.

The toilet flushing apparatus herein disclosed is primer tank activated, simply by flooding the flush pipe with water at velocity from a syphon discharge tube in order to initiate syphoning that depletes the water supply tank during each flushing operation. Accordingly, this invention is characterisized by a syphon discharge and a flush tube, and by a rechargeable primer tank that establishes a head of primer water that is released by a flush valve to initiate syphoning followed by continued syphoning. In practice, the syphon tube flow activation is such as to require but a small quantity of water, a pint or two, discharged at the bottom opening of the discharge tube of the syphon. It is to be understood that operation of this flushing apparatus is dependent upon refilling of the water supply tank by a water level control, such as a float controlled water level valve or the like, so that the tank water returns to the bridge level of the syphon and subsequently refills the primer tank after each flushing operation.

The foregoing and various other objects and features of this invention will be apparent and fully understood from the following detailed description of the typical preferred forms and applications thereof, throughout which reference is made to the accompanying drawing.

THE DRAWINGS

Figure 1:
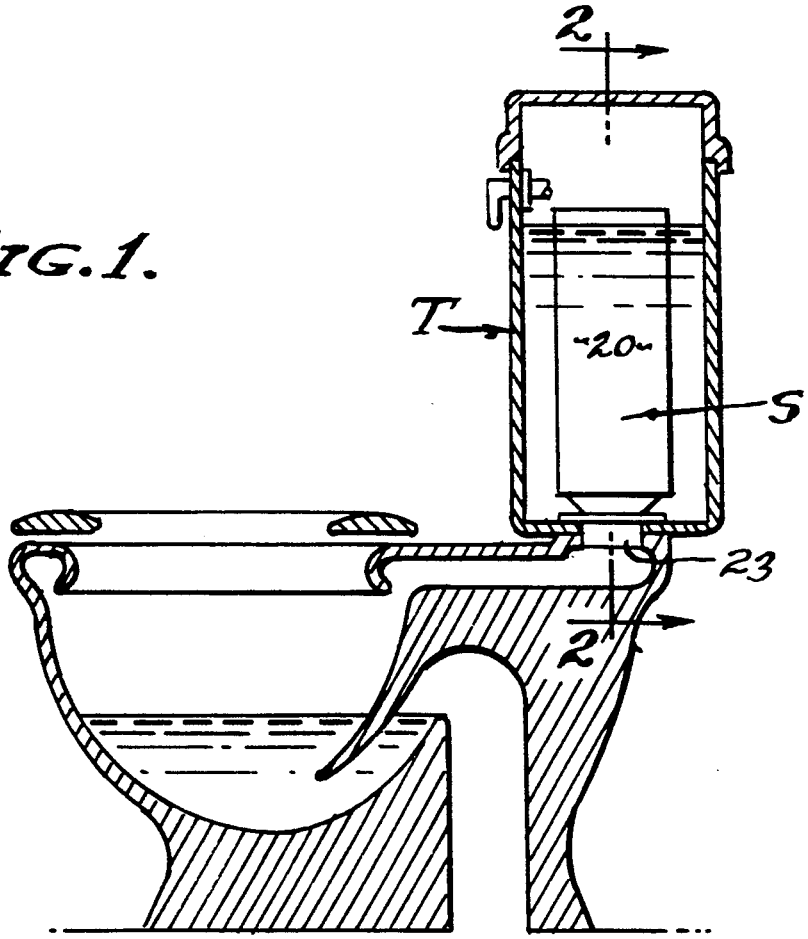
FIG. 1 is a cross sectional view of a toilet with the flushing apparatus of either the first or second embodiment of the present invention installed therein.
Figure 2:
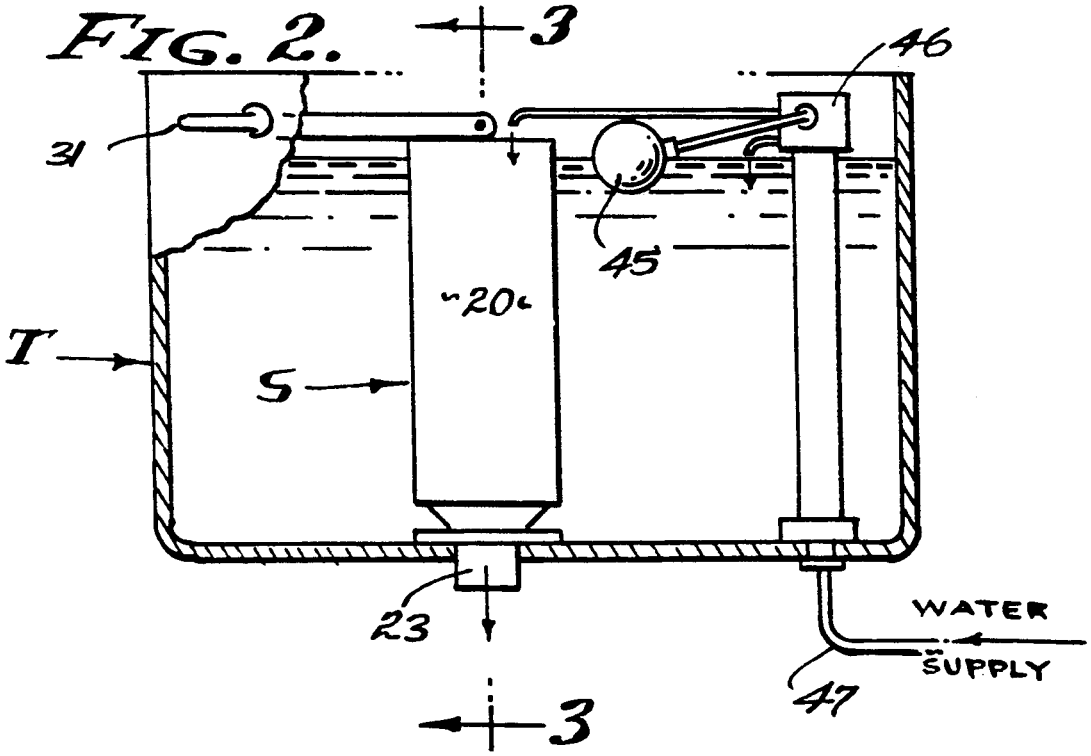
FIG. 2 is a sectional view taken as indicated by line 2—2 on FIG. 1, showing a passive ready condition.
Figure 4:
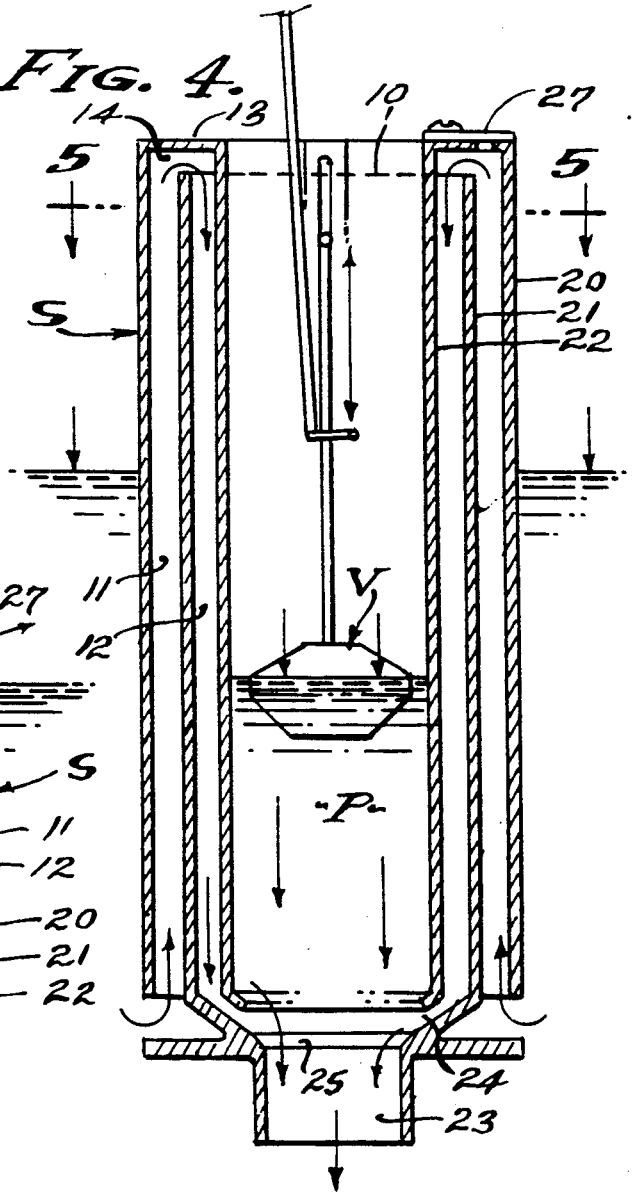
Figure 3:
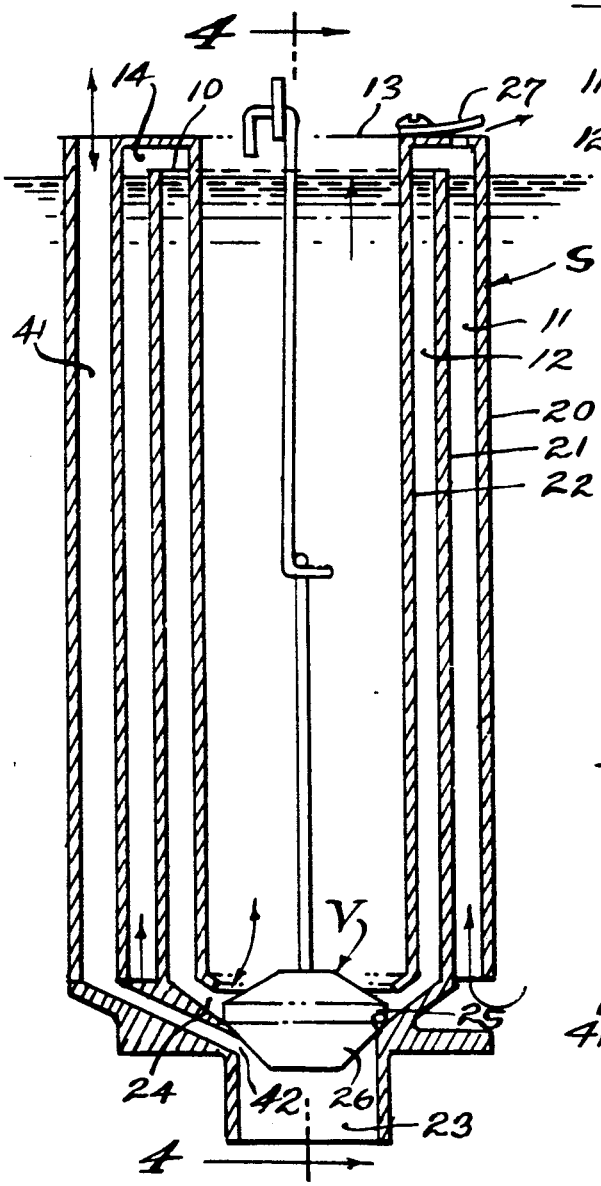
Figure 5:
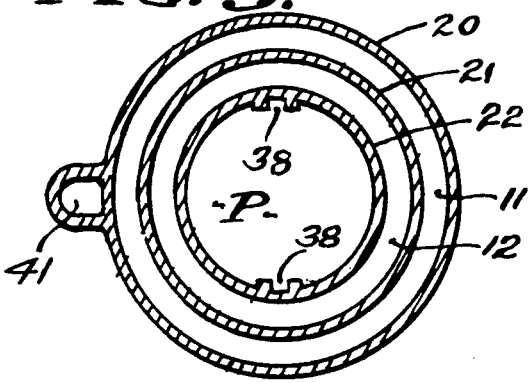

FIGS. 3 to 5 are enlarged sectional views of the first embodiment, FIG. 3 being a vertical section taken as indicated by line 3—3 on FIG. 2, FIG. 4 being a vertical section showing the operated condition and taken as indicated by line 4—4 on FIG. 3, and FIG. 5 being a transverse section taken as indicated by line 5—5 on FIG. 4.

Figures 6, 7, 8:
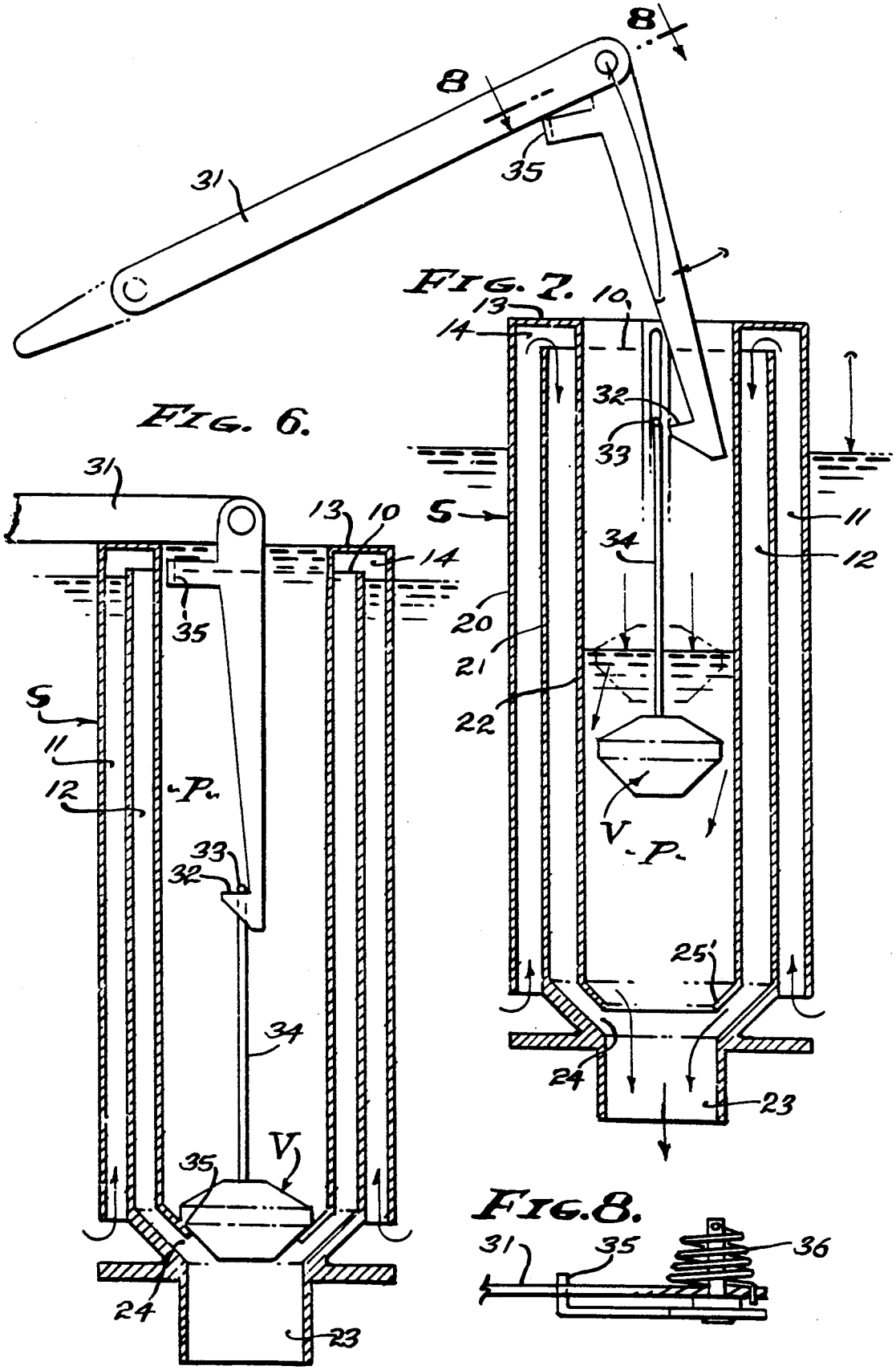

FIGS. 6 to 8 are enlarged sectional views of the second embodiment, FIG. 6 being a vertical section similar to FIG. 3, and FIG. 7 being a vertical section similar to FIG. 4; and FIG. 8 is an enlarged fragmentary view taken as indicated by line 8—8 on FIG. 7.

PREFERRED EMBODIMENT

Referring now to the drawings, the toilet and water supply tank T are conventional in every respect. And,- the tank water level is controlled by a conventional float valve, so that the water supply level reaches a predetermined position just below a weir or bridge 10 of a syphon S within the supply tank. In accordance with this invention, there is the syphon S comprised of a suction leg 11 and a discharge leg 12, preferably concentric tubes 21 and 22 wherein the suction leg 11 is an annulus that surrounds the discharge leg 12 opening into a flush pipe 23. The suction leg opens from the bottom of the tank T and over the bridge 10 and into the top of the discharge leg 12 via a transfer chamber 14, the suction leg 11 being filled with tank water to the bridge level. In a second embodiment (FIGS. 6–8) the discharge leg 12 is drained empty after each flushing. The transfer chamber 14 closes the top of the annuli between tubes 20, 21 and 22 forming a passage joining the two legs. A feature is the annular configuration of the discharge leg 12 and its inwardly turned foot or bottom jet opening 24 discharging circumferentially into the flush pipe 23 when the flush valve V is lifted. The discharge leg 12 is filled with water after each flushing in the first embodiment (FIGS. 3–5), whereas said leg remains empty of water after each flushing in the second embodiment (FIGS. 6 and 8). The suction leg 11 refills in both embodiments.

The toilet fixture is conventional, having a water supply tank T that is automatically filled with water by means of a float 45 controlled valve 46 from a water supply pipe 47. The water level in tank T is limited to a predetermined point just below the bridge 10 of the syphon S. The valve 46 discharges into the supply tank T and/or into the primer tank P in the usual manner, as is clearly shown in the drawings.

A feature herein disclosed is the syphon comprised of concentric tubes, wherein the suction leg 11 of the syphon surrounds the discharge leg 12 (see FIG. 5). The suction leg 11 opens from the bottom of the tank T and into the discharge leg 12 via the header transfer passage 14, the suction leg being filled with tank water to the bridge 10 level in the passive ready condition. Closely overlying the weir or bridge 10, there is an upper header 13, forming the closed transfer chamber 14 at the joinder of the two legs, said chamber being defined when the water level rises to a maximum at the bridge 10.

In accordance with this invention, the inner diameter wall of the discharge leg 12 is a tube 22 that forms a primer tank P open at its top and closed by a flush valve V at its bottom and to the flush pipe 23. The flush valve V is a floatable ball valve or the like, passively seated at or within the jet opening 24. The circumferential jet opening 24 is substantially coincidental in diameter with the peripheral diameter of the flush valve V and also with the inside diameter of the flush pipe 23. Variation in the jet opening 24 diameter occurs according to the choice of the two embodiments herein disclosed and as next described.

Referring now to the first pre-primed embodiment of FIGS. 3 to 5, the passive ready condition of the apparatus provides wet legs 11 and 12, in which case the flush valve is seated at the top of the flush pipe 23 and below the open bottom of the primer tank P and within the surrounding jet opening 24 (see FIG. 3). Accordingly, the inwardly turned discharge diameter of the jet opening 24 is greater in diameter than the peripheral diameter of the flush valve V, whereby the valve can be withdrawn upwardly therethrough so as to simultaneously open both the primer tank P and the jet opening 24 to the flush pipe 23 (see FIG. 4). The tube 22 is substantially greater in diameter than the flush valve V, so that there is free water flow over and around the valve V as and when it is lifted and initially permits rapid flow downwardly over the jet opening. After lifting the flush valve V to its height limit and upon its release, said floatable valve is permitted to float downward with the rush of water from the primer tank P, until it reaches the discharge of supply tank water discharging from the jet opening 24. A feature is that premature closure of the flush valve V is prevented by the flow of supply tank water from the jet opening 24, as next described.

In the first embodiment now under consideration, the valve seat 25 is immediate to the inner diameter of the flush pipe 23 and is typically upwardly and outwardly inclined at an angle to interface with the engaging surface of the flush valve V that seats thereon. As shown, the sealing face 26 of the flush valve V is conical at the same angle as said seat 25, for example at 45°. In accordance with this invention, the jet opening is downwardly and inwardly declined at a lesser angle than said face 26, for example at 35°. Accordingly, the thrust of supply tank water discharged against the face 26 causes an upward reaction that supports the flush valve V until the flow of water subsides, whereupon the flush valve V drops onto the seat 25.

Refilling of the first embodiment syphon requires the exhaust of atmosphere from the legs 11 and 12, and also from the transfer chamber 14, and to this end I provide a relief valve 27 means (see FIGS. 3 and 4). This valve can vary in form and is shown as a flap valve that checks air flow from outside atmosphere while permitting the free exhaust of air as the legs 11 and 12 are filled with water to the bridge 10.

Referring now to the second jet primed embodiment of FIGS. 6 to 8, the passive ready condition of the apparatus provides a wet leg 11 and a dry leg 12. In which case the flush valve is seated at the bottom of the primer tank P, above the surrounding jet opening 24 and above the flush pipe 23 (see FIGS. 6 and 7). Accordingly, the inwardly turned discharge diameter of the jet opening 24 is of lesser diameter than the peripheral diameter of the flush valve V, whereby the valve seat 25' is within the bottom of the primer tank P. Thus, seating of the flush valve V retains a head of water in the primer tank P without affect upon the open communication of the discharge leg 12 with the flush pipe 23 (see FIGS. 6 and 7). When the primer tank P is closed by the flush valve V, the discharge leg 12 and flush pipe 23 remain empty and in open communication via the peripheral jet opening 24.

Lifting of the flush valve V from its seat 25', as shown in FIG. 7, causes it to float upwardly as shown by phantom lines in FIG. 7, whereupon the downward rush of water from the primer tank P discharges over the jet opening 24 and creats a suction that draws water from the suction leg 11 and over the bridge 10 to flood the discharge leg 12 to thereby initiate the syphon effect. The flush pipe 23 opens directly into the toilet bowl.

In FIGS. 6 and 7 of the drawings, a manual lever operation is shown, wherein a depressible lever 31 lifts a hook 32 that is disengageable from a bail 33 formed on the stem 34 of the valve element. The hook 32 has a stop member 35 biased into engagement with lever 31 so as to swing the hook away from the bail when lifted as shown in FIG. 7, and to permit reengagement as shown in FIG. 6. A feature is the spring coupling member 36 shown in FIG. 8, the spring applying rotating torque to the hook arm and compression to releasably engage the stop member 35 with the arm, as shown. The bail 33 is guided in the primer tank P by opposite channels 38 as shown in FIG. 5.

The float controlled filler valve 46 remains as a leakage factor, which in the first embodiment of FIGS. 3 to 5 leakage of said valve 46 will result in an overflow from tank T, providing that the flush valve V is effectively leakproof, and which in the second embodiment of FIGS. 6 to 8 leakage of valve 46 will result in discharge over the syphon bridge 10 and through the flush pipe 23. In both embodiments, leakage of flush valve V disables the ready condition and requires refilling of the primer tank P and preferably repair of the valve V and/or its seat 25—25'. In the first embodiment of FIGS. 3 to 5, overflow as may be caused by a leaking filler valve 46 is diverted as waste water through the flush pipe 23. Diversion of waste water is shown in FIG. 3 and 5, wherein a standpipe 41 opens from the top plane of header 13 above the bridge 10, and into the flush pipe 23 at 42 below the flush valve seat 25.

This flushing system features the absence of continuous water leakage by valves which have heretofore become defective. Only one small primer tankful of water can be lost through malfunction of the flush valve V. This renders this system superior with respect to the relatively large volume of water stored in the supply tank ready for flushing and which continuously leaks as waste water in conventional non-syphon toilets. Water is inherently conserved when practicing this invention.

Having described only the typical preferred forms and applications of my invention, I do not wish to be limited or restricted to the specific details herein set forth, but with to reserve to myself any modifications or variations that may appear to those skilled in the art as set forth within the limits of the following claims.

I claim:

1. A primer activated wet discharge syphon flusher for toilets having a flush tank and a flush pipe opening into a toilet bowl, and having a water level control means responsive to depletion of water in said tank to refill said tank to a predetermined water level, and including;

a syphon within the flush tank and comprised of inner and outer tubes and an intermediate tube defining a suction leg opening within the bottom of said tank and extending upward to a bridge at the aforesaid predetermined water level, and a discharge level continuing from the suction leg and extending downward from the bridge and discharging downwardly and inwardly through an annular jet opening and into the flush pipe, a closed header extending between said inner and outer tubes and spaced above the bridge to define a transfer passage connecting a wet suction leg and a wet discharge leg of the syphon, there being a relief valve means opening from the transfer passage to check air flow from outside atmosphere while permitting free exhaust of air from within said header for refilling the two legs of the syphon, a primer tank defined by and within the inner tube and having an open bottom discharge at said jet opening, the top of the flush pipe being passively closed by a floatable flush valve engageable on a seat disposed below the jet opening, and the primer tank being refilled by said water level control means to a water level coincidental with said predetermined water level and to discharge at said jet opening and into the flush pipe when the flush valve is opened, and means for opening the floatable flush valve to initiate syphoning by discharge of primer tank water over the jet opening and inducing a suction effect causing wet suction leg water to rise over the bridge and into the water within the wet discharge leg water and from said jet opening and through said seat and into the flush pipe, and continuing until the flush tank water level is depleted.

2. The primer activated syphon flusher for toilets as set forth in claim 1, wherein the discharge leg of the syphon surrounds a tubular wall of the primer tank and at the bottom of which tubular wall the jet opening discharges annularly into the flush pipe.

3. The primer activated syphon flusher for toilets as set forth in claim 1, wherein the suction leg, discharge leg and primer tank are formed of concentric tubes, the discharge leg of the syphon and the primer tank sharing a common tubular wall at the bottom of which the jet opening discharges annularly and into the flush pipe.

4. The primer activated syphon flusher for toilets as set forth in claim 1, wherein the discharge leg of the syphon surrounds a tubular wall of the primer tank and at the bottom of which tubular wall the jet opening discharges annularly into the flush pipe, and wherein the flush valve closes passively upon a seat at the upper end of the flush pipe and below the jet opening and below the discharge of the primer tank.

5. The primer activated syphon flusher for toilets as set forth in claim 1, wherein the suction leg, discharge leg and primer tank are formed of concentric tubes, the discharge leg of the syphon and the primer tank sharing a common tubular wall at the bottom of which the jet opening discharges annularly and into the flush pipe, and wherein the flush valve closes passively upon a seat at the upper end of the flush pipe and below the jet opening and below the discharge of the primer tank.

6. The primer activated syphon flusher for toilets as set forth in claim 1, wherein the flush valve is flotable and closes passively upon a seat at the upper end of the flush pipe and below the jet opening and discharge of the primary tank, the bottom seating face of the flush valve being upwardly and outwardly inclined to interface with the seat and the jet opening being downwardly and inwardly declined at a lesser angle than said seating face of the flush valve, whereby supply tank water discharged against the bottom seating face of the flush valve causes an upward reaction to prevent its premature seating.

7. The primer activated syphon flusher for toilets as set forth in claim 1, wherein the means for opening the flush valve is comprised of a manually operable lever engaged with and to lift a hook disengageable from a bail on a guided stem of the flush valve, there being a stop member between the lever and hook to disengage the hook from the bail when the flush valve is lifted for primer tank water discharge, and to re-engage the hook and bail when the primer tank is passively closed by the flush valve.

* * * * *